US005088749A

United States Patent [19]

Olivieri

[11] Patent Number: 5,088,749

[45] Date of Patent: Feb. 18, 1992

[54] ICE SKATE WITH INTERCHANGEABLE SKID BLADE

[75] Inventor: Oliviero Olivieri, Treviso, Italy

[73] Assignee: Icaro Olivieri & C. S.p.A. Minuterie, Metalliche, Italy

[21] Appl. No.: 557,835

[22] Filed: Jul. 26, 1990

[30] Foreign Application Priority Data

Nov. 10, 1989 [IT] Italy ..... 22347 A/89

[51] Int. Cl.[5] ..... A63C 1/30

[52] U.S. Cl. ..... 280/11.18; 280/7.13

[58] Field of Search ..... 280/7.12, 7.13, 7.14, 280/10, 11.12, 11.17, 11.18, 11.27, 600, 611, 845, 11.3, 11.31, 11.32, 11.33, 11.34

[56] References Cited

U.S. PATENT DOCUMENTS

| | | | |
|---|---|---|---|
| Re. 19,706 | 9/1935 | Johnson | 280/11.3 |
| 109,451 | 11/1870 | Poole et al. | 280/11.3 |
| 1,608,963 | 11/1926 | Smilden | 280/11.18 X |
| 2,213,966 | 9/1940 | Nygaard | 280/11.18 |
| 3,026,118 | 3/1962 | Paré | 280/7.13 X |
| 3,292,940 | 12/1966 | Weitzner | 280/7.13 |
| 3,367,669 | 2/1968 | Collins | 280/11.3 |
| 4,218,069 | 8/1980 | Baikie | 280/11.12 |
| 4,223,900 | 9/1980 | Olivieri | 280/11.18 X |
| 4,251,086 | 2/1981 | Woolley | 280/11.18 X |
| 4,907,813 | 3/1990 | Hall | 280/11.18 |
| 4,928,549 | 5/1990 | Nagano | 280/11.3 X |
| 4,932,675 | 6/1990 | Olson et al. | 280/7.13 |

FOREIGN PATENT DOCUMENTS

| | | | |
|---|---|---|---|
| 759294 | 4/1953 | Fed. Rep. of Germany | 280/11.18 |
| 833716 | 10/1938 | France | 280/11.18 |
| 223321 | 11/1942 | Switzerland | 280/11.18 |
| 2128483 | 5/1984 | United Kingdom | 280/11.18 |

*Primary Examiner*—David M. Mitchell
*Assistant Examiner*—Brian L. Johnson
*Attorney, Agent, or Firm*—Sughrue, Mion, Zinn, Macpeak & Seas

[57] ABSTRACT

An ice skate has a support and a skid blade which can be coupled together in bayonet-like relationship and employs a mechanism for locking the coupling incorporated to the support and actuatable manually from the exterior thereof.

6 Claims, 3 Drawing Sheets

ICE SKATE WITH INTERCHANGEABLE SKID BLADE

BACKGROUND OF THE INVENTION

This invention relates to an ice skate with an interc-nangeable skid blade.

More particularly, this invention concerns an ice skate of a type which includes a support wherein at least one toe sole portion and at least one heel portion are defined which are overhung from the said side thereof, and a skid blade secured to said support and extending longitudinally thereof on the opposite side from said overhung portions.

The technical problem that this invention is directed to solve is that of devising and providing an ice skate which is so constructed as to allow prompt replacement of the skid blade with another, similar or different skid blade, easily and using no ancillary equipment or tools, thereby such an operation can be performed by the user alone, all this without affecting in any way the rigid coupling characteristics and substantially unitary construction of the support-skid blade assembly of such a skate.

SUMMARY OF THE INVENTION

This problem is solved according to the invention in that the support includes at least one seat for receiving a corresponding portion of said skid blade in press fit relationship, means being arranged to lock said coupling in substantially bayonet-like form, and means being provided in said support, and actuatable from the support exterior to prevent release of said locking means.

In accordance with a second characteristic of this invention, the locking means substantially in bayonet coupling form includes a recess provided in said seat and extending toward the heel portion of said support, and a dog overhanging from said skid blade and pointing toward the rear thereof, which dog is adapted to engage slidably in said recess.

BRIEF DESCRIPTION OF THE DRAWINGS

The invention features and advantages will become apparent from the detailed description which follows of a preferred, but not exclusive, embodiment thereof, to be read with reference to the accompanying illustrative and nonlimitative drawings.

In the drawings.

DETAILED DESCRIPTION OF THE INVENTION

Figure 1:
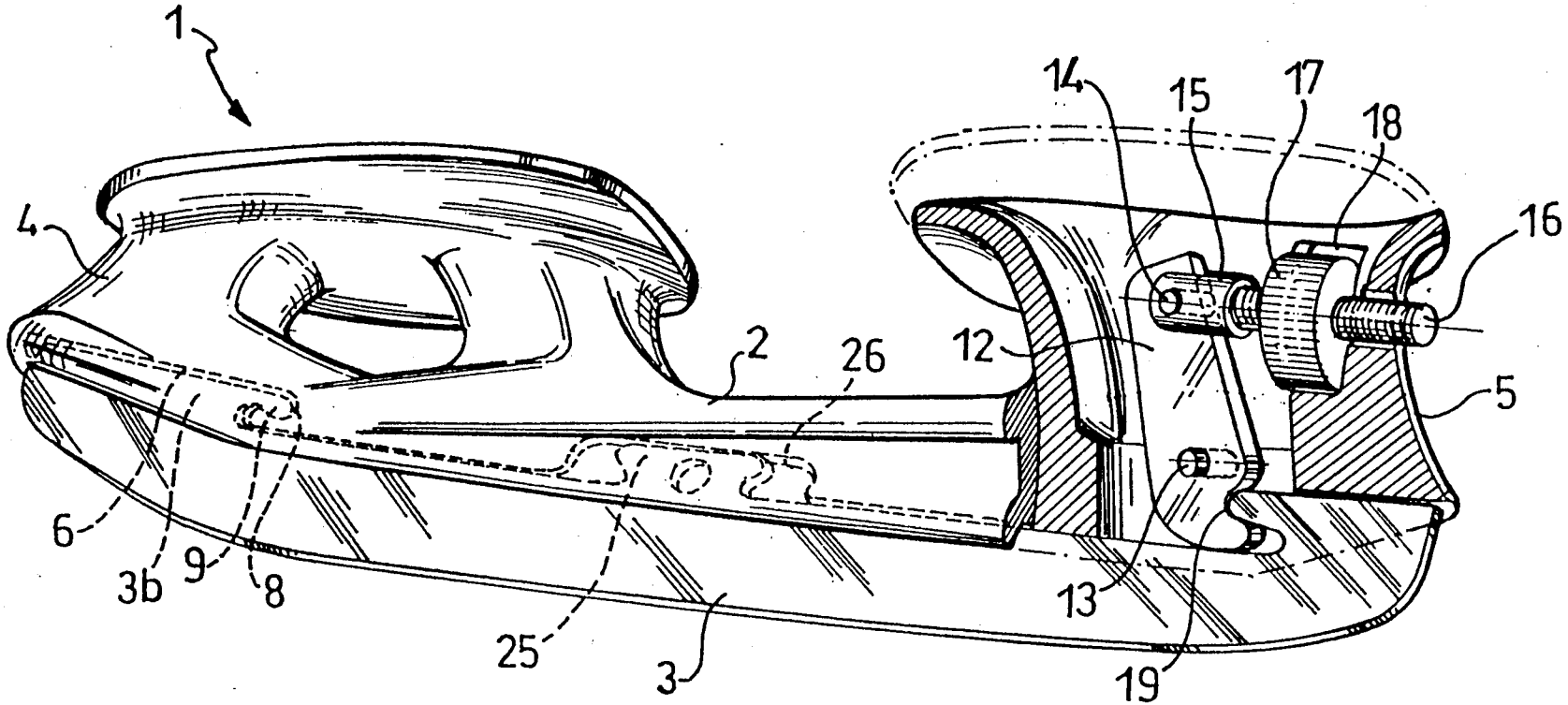
FIG. 1 shows in perspective and part-section an ice skate according to the invention.

With reference to the drawing views, generally shown at 1 is an ice skate according to the invention and comprising a support 2 and a skid blade 3.

The support 2 is formed from a suitable plastics by conventional techniques and includes a sole portion 4 and a heel portion 5, both of hollow construction and overhung or extending from the same side of the support.

On the opposite side from said portions 4 and 5, the support 2 is formed with a groove 7 longitudinally thereof, which has a predetermined depth and width to receive a matching longitudinal portion 3*a* of the skid blade 3 in push or press fit relationship.

At the location of the sole portion 4, the groove 7 opens into a seat 6 formed in the support 1 and is adapted to be engaged by a toe portion 3*b* of the blade 3. In particular, the length of the seat 6 is greater than that of the toe portion 3*b* of the blade 3, and its width is sized to be a press fit with said toe portion.

A recess 8 is formed in the bottom of the seat 6 which extends on one side of said seat longitudinally of the support 2 toward the heel portion 5 of the latter.

Advantageously, the recess 8 has a circular arc profile shape subtending a greater angle than 180 degrees, such that a lip 8*a*, also having a circular arc profile shape, is defined at the inlet mouth of said recess.

Formed on the toe portion 3*b* of the blade 3 is a dog 9 overhanging longitudinally from the blade toward the rear of the latter and having a circular arc profile shape substantially mating the profile shape of the recess 8 into which it is adapted to engage in press-fit relationship, as explained hereinafter.

The support 2 is provided, at its heel end, with a seat 10 which opens both into the groove 7 and inwardly of the hollow heel portion 5 of said support.

Said seat 10 also has a width dimension adapted to receive in press-fit relationship a trailing portion 3*c* of the blade 3. Defined on this trailing portion 3*c* is a dog 11 jutting out toward the toe portion of the blade 3 and having a semicircular profile shape.

A plate-like lever 12 is housed within the heel portion 5 of the support 2, being pivoted therein about a pivot pin 13 which is carried on said portion and extends across the seat 10. The top end of said lever 12 is journalled on a peg 14 carried on the head 15 of a screw 16 which is supported rotatably on the heel portion 5. The screw 16 can be rotated by means of a knurled wheel 17 housed within the hollow portion 5 and accessible from the exterior of the latter through two windows 18 which are formed through the juxtaposed walls of said portion 5. Advantageously, the wheel 17 has a diameter dimension whereby it will protrude through said windows 18 and a thickness dimension whereby it bears substantially on the juxtaposed sides of each of said windows 18.

In the other end of the plate-like lever 12, there is formed laterally a contour or recess 19 of circular profile shape having such a diameter dimension as to engage with the dog 11 of the trailing or heel portion 3*c* of the blade 3.

A blade 3 is fitted to the support 2 as follows.

Figure 2:
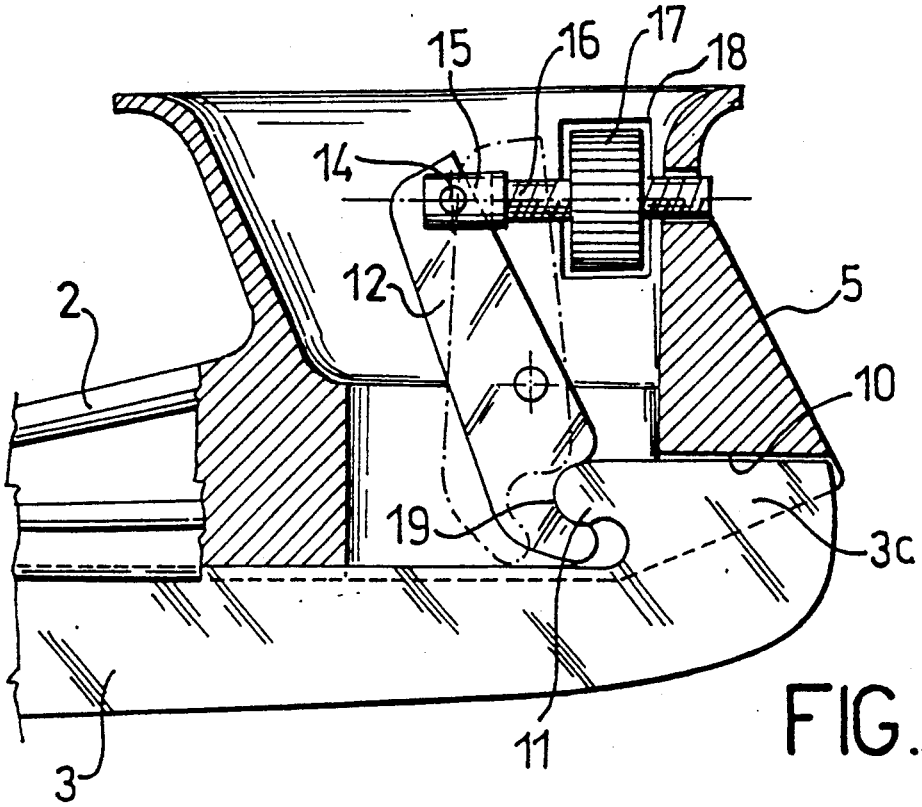
FIG. 2 is a part-sectional view of a detail of FIG. 1, drawn to an enlarged scale.

By manipulating the screw 16, the plate-like lever 12 is moved angularly to a rest position shown in phantom lines in FIG. 2.

The blade 3 is press-fitted into the groove 7, being careful to avoid interference of the dog 9 of the toe portion 3*b* with the lip 8*a* of the recess 8. The inward movement of the blade 3 stops on the toe 3*b* and heel 3*c* portions thereof contacting the bottoms of the respective seats 6,10.

The skid blade 3 is acted upon so as to move it lengthwise and rearwards relatively to the support 13, that is, toward the heel portion 5 of said support. This movement will be resisted at first by the slight interference of the dog 9 with the lip 8*a* of the recess 8. Following substantially elastic deformation of the lip 8*a*, the dog 9 will then engage the recess 8 into a bayonet-type coupling.

After this engagement is accomplished, the plate-like lever 12 is driven angularly about its respective pivot point 13 by operation of the wheel 17, the lever movement continuing until the recess 19 becomes fully engaged with the dog 11 on the heel or trailing portion 3*c* of the blade 3. The screw 16 rotation should be continued as far as possible, such that the screw forms a detent for locking the lever 12 and, at the same time, provides a useful constraint for the bayonet coupling 8-9. The coupling of the blade 3 with the support 2 is an extremely rigid one, forming an essentially unitary support/blade assembly.

For quick removal of the blade, one would proceed as follows. By operation of the wheel 17, the plate-like lever 12 is disengaged from the dog 11 on the heel portion 3*c* of the blade 3. Thereafter, the skid blade is pushed forward (such as by striking on the rear thereof) so as to disengage the elements 8-9 of the bayonet coupling, thereby the blade 3 can be drawn out by applying a small force from the corresponding groove 7 in the support 2.

The support is now ready to receive a fresh blade 3 or a different blade, on condition that it be provided with a forward dog 9 and rearward dog 11, at appropriate locations to engage in the recess 8 of the support 2 and with the plate-like lever 12, respectively.

Figure 4:
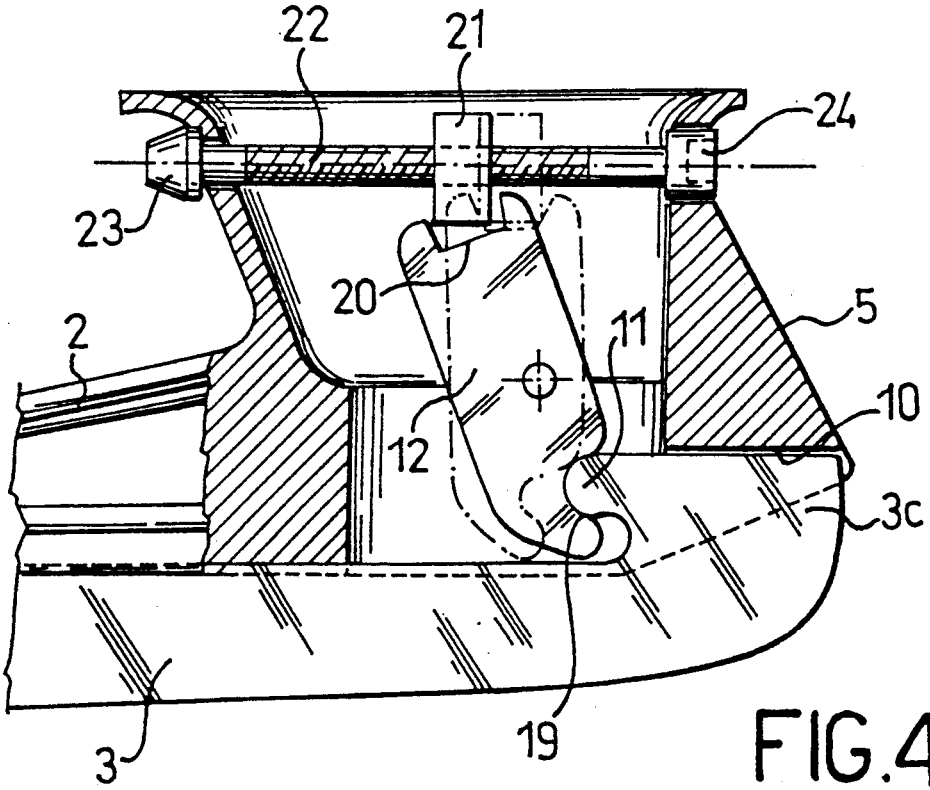
FIG. 4 is a part-sectional view of a modified embodiment of the skate detail shown in FIG. 2.
Figure 3:
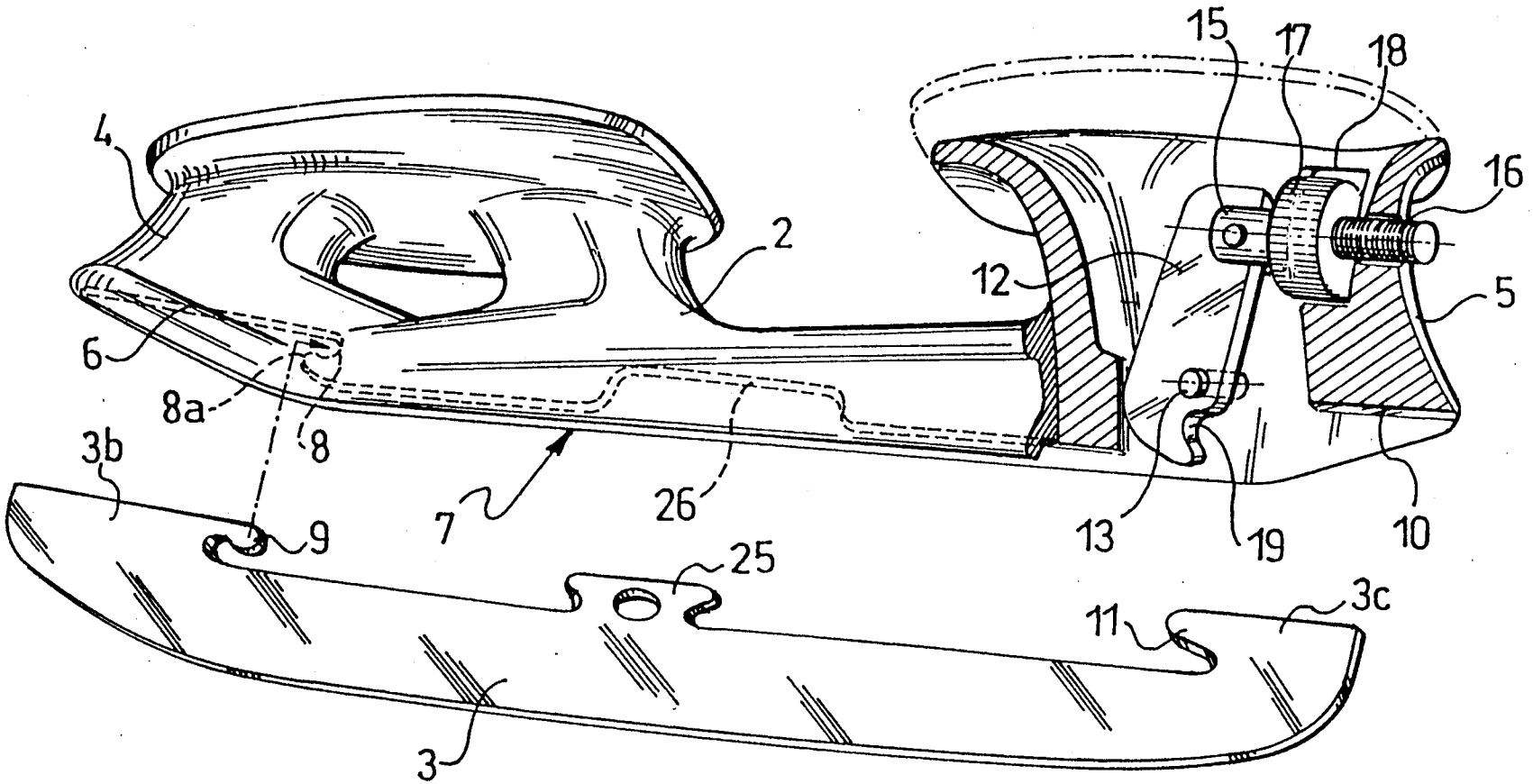
FIG. 3 is an exploded view showing, in perspective and part-section, the same ice skate as in FIG. 1.

In FIG. 4, there is shown a modified embodiment of the means for operating the plate-like lever 12.

In this variation, the top or upper portion of the lever 12 is formed with an essentially rectangular recess 20 which is engaged by a nut 21 threaded onto a screw 22 which is supported rotatably o the heel portion 5 of the support 2. The screw 22 has opposed ends provided with respective heads 23 and 24. The head 23 provides a detent for the screw 22 setting, and the head 24, to be accessible from the exterior of the portion 5, may be of the Allen type for engagement by a suitable tool.

Advantageously, in order to enhance the unitary nature of the support 2-blade 3 coupling, the blade is provided with a lug 25 at a central location thereon which juts outwards and is adapted to engage in a seat 26 correspondingly formed in the support 2 and opening into the groove 7. This seat 26 has a suitable depth and such a width as to accommodate the lug 25 in press-fit relationship.

Advantageously, the seat 26 could be formed with a recess quite similar to the previously described recess 8 in connection with the seat 6 and adapted to engage with a dog formed on the lug 25, quite in the same manner as the dog 9 formed on the toe portion 3*b* of the skid blade 3.

The ability to quickly exchange the skid blade of an ice skate according to the invention, which exchange can be effected by the skate user him/herself, constitutes a major advantage afforded by this invention. This becomes apparent when it is considered that the intervals for such exchange may be quite frequent, such as to have the skid blade sharpened. This advantage is further enhanced by that, again through simple operations to be performed by the user, the coupling of the blade to the support positively provides a substantially unitary assembly which can successfully withstand the considerably high stresses to which the assembly is subjected during the practice of the sport.

Another non-negligible advantage is that the exchange can be performed quickly without the footwear having to be removed from the respective support.

As a result, where the user is equipped with one or more pairs of sharpened blades, the skid blades could be replaced on several occasions in one day.

A further non-negligible advantage is that a skid blade may be replaced with another having different characteristics, thereby the skater may be offered a pair of ice skates with the option of a set of blades, one (or more) for each of the sport specialties of interest, such as blades for figure, speed, hockey playing, etc.

The invention as described may be variously altered by one skilled in the art without departing from its protection scope as set forth in the appended claims. Thus, as an example, the dog 9 and corresponding recess 8, which constitute the locking means of the bayonet coupling type, could be arranged to point toward the toe end of the blade 3 and the support 2, rather than the heel end thereof; further, the dog 11 could also be arranged to face outwards from the blade 3 and for engagement in a corresponding recess formed in the lever 12 on the side of the latter facing the center of the support 2. More variations may be made to the design of the means for operating the lever 12.

I claim:

1. An ice skate with an interchangeable skid blade, said ice skate comprising:

a support on which there are defined at least one toe sole portion and at least one heel portion which extend from a common side of said support; and a skid blade secured to said support and extending longitudinally thereof on an opposite side from said toe sole and heel portions, wherein the support includes at least one seat for receiving a corresponding portion of said skid blade in a press-fit relationship;

said ice skate further comprising a bayonet locking means for locking said skid blade to said support; and means for preventing release of said locking means being disposed in said support and actuatable from an exterior of said support, wherein said heel portion of said support includes a hollow portion, said means for preventing release of said locking means being housed within said hollow portion, and further wherein said means for preventing release of said locking means comprises a plate-like lever journalled on a pivot pin mounted on said support within said hollow portion of said heel portion, said lever having opposite ends with one end acted upon by a screw accessible from the exterior of said heel portion of said support and the other end contoured to engage with a corresponding dog formed on a trailing portion of said skid blade.

2. An ice skate according to claim 1, wherein said bayonet locking means comprises a recess formed in said seat longitudinally of the support and a dog extending from said skid blade and lying longitudinally thereof and being adapted to engage slidably in said recess.

3. An ice skate according to claim 2, wherein said recess has a circular arc profile shape subtending a greater angle than 180 degrees to form a lip at an inlet thereof, said lip being deformed elastically as said dog is bayonet fitted into said recess.

4. An ice skate according to claim 3, wherein said recess and said dog face toward said heel portion.

5. An ice skate according to claim 1, wherein said hollow portion of said support is defined by juxtaposed walls, said walls having a pair of windows therein, and wherein said screw includes a knurled wheel mounted thereon, said knurled wheel being accessible through said windows.

6. A support for ice skates, said support comprising a toe sole portion and a hollow heel portion extending from a common side of said support, wherein said support comprises a groove extending longitudinally on an opposite side from said toe sole and heel portions, said groove having a predetermined depth and suitable with do as to engage in press-fit relationship with a corresponding portion of an ice skate skid blade, a first seat located proximate to said toe sole portion and open into said groove, a recess formed at a bottom of said first seat and extending longitudinally of said support, said first seat and said recess being adapted to engage, into a substantially bayonet-type coupling, with a corresponding toe portion of the ice skate skid blade and with a respective dog formed on said toe portion, a second seat formed in said support and located proximate to the heel portion, which second seat opens to an interior of said hollow heel portion and into said groove, said second seat having a predetermined depth and suitable width to receive in press-fit relationship a corresponding trailing portion of the ice skate skid blade, a lever journalled on a pivot pin mounted on said support within said hollow heel portion and having one end acted upon by a screw accessible from an exterior of said hollow heel portion and an opposite end provided with a recess adapted to engage releasably with a corresponding dog formed on the trailing portion of said ice skate skid blade.

* * * * *